US005671558A

United States Patent [19]

Lakin

[11] Patent Number: 5,671,558

[45] Date of Patent: Sep. 30, 1997

[54] FLUSH VALVE ADVERTISING DISPLAY DEVICE

[76] Inventor: Donald D. Lakin, 1011 S. 22nd St., Omaha, Nebr. 68108

[21] Appl. No.: 614,788

[22] Filed: Mar. 8, 1996

Related U.S. Application Data

[63] Continuation-in-part of Ser. No. 312,261, Sep. 26, 1994.

[51] Int. Cl.[6] ..... G09F 3/18

[52] U.S. Cl. ..... 40/661; 40/307; 40/331; 40/607; 137/382; 137/559

[58] Field of Search ..... 40/307, 311, 331, 40/332, 626, 666, 607, 661; 4/434; 137/559, 382, 377; 285/93, 404, 405; 403/362, 320, 378

[56] References Cited

U.S. PATENT DOCUMENTS

| | | | |
|---|---|---|---|
| 1,530,679 | 3/1925 | Lambert | 285/405 X |
| 1,828,896 | 10/1931 | Hershey . | |
| 1,854,689 | 4/1932 | Carter | 40/315 |
| 1,911,095 | 5/1933 | Sneierson . | |
| 1,986,409 | 1/1935 | Redmer | 40/331 |
| 1,993,938 | 3/1935 | McDonald | 206/19.5 |
| 2,206,707 | 7/1940 | Shaw | 137/382 |
| 2,823,479 | 2/1958 | Zdanowski | 41/34 |
| 3,225,479 | 12/1965 | Kanitz | 40/332 |
| 3,410,247 | 11/1968 | Dronberger | 116/133 |
| 3,430,377 | 3/1969 | Ellison | 40/332 |
| 3,538,882 | 11/1970 | Price | 40/607 X |
| 3,610,461 | 10/1971 | Allyn | 40/306 X |
| 3,977,105 | 8/1976 | Tsubouchi . | |
| 4,306,751 | 12/1981 | Wegner | 403/337 X |
| 4,389,802 | 6/1983 | McLaren et al. | 40/307 |
| 4,422,325 | 12/1983 | Sutherland et al. | 73/273 |
| 4,465,209 | 8/1984 | Wilder | 222/23 |
| 4,484,595 | 11/1984 | Vanek et al. | 137/382 X |
| 4,750,411 | 6/1988 | Eversole | 285/405 X |
| 4,899,781 | 2/1990 | Monroe | 137/382 |
| 4,971,287 | 11/1990 | Shaw | 251/30.05 |
| 4,979,325 | 12/1990 | White | 40/661 |
| 5,195,720 | 3/1993 | Nortier et al. | 137/382 X |
| 5,238,141 | 8/1993 | Callegari et al. | 137/382 X |
| 5,253,674 | 10/1993 | Argyle et al. | 137/559 |
| 5,431,453 | 7/1995 | Yamashita | 285/404 X |

FOREIGN PATENT DOCUMENTS

| | | | |
|---|---|---|---|
| 842958 | 7/1952 | Germany | 137/382 |

*Primary Examiner*—Peter M. Cuomo
*Assistant Examiner*—James O. Hansen
*Attorney, Agent, or Firm*—Henderson & Sturm

[57] ABSTRACT

An advertisement display device which is removably secured to a toilet flush valve cap. The device is comprised of a clear plastic valve cap cover which receives advertisements therein and is then placed over the valve cap. The device may be secured onto the valve cap by means of one or more set screws, and is held in position by means of the toilet water inlet pipe.

5 Claims, 3 Drawing Sheets

FLUSH VALVE ADVERTISING DISPLAY DEVICE

This is a continuation-in-part application of co-pending U.S. patent application Ser. No. 08/312,261 filed on Sep. 26, 1994 and entitled "Flush Valve Advertising Display Device".

TECHNICAL FIELD

This invention relates to advertising display devices.

BACKGROUND ART

Advertisers of goods and services are in constant search of the so-called "captive audience", in which a member of a potential consumer group is placed in such a position than he can hardly avoid exposure to the advertisement directed to him. Motorists are constantly subjected to advertising on highway billboards, and there is little one can do to avoid this exposure. Radio and television advertising is almost as invasive as the only practical was to avoid the advertisements is to turn the radio or television off.

DISCLOSURE OF THE INVENTION

The present invention strives to set a new standard for the term "captive audience" inasmuch as the invention directs advertising to those members of the population involved in a necessary bodily function.

The present invention discloses an advertisement display device which is removably secured to a toilet flush valve cap. The device is comprised of a clear plastic valve cap cover which receives advertisements therein and is then placed over the valve cap. The device may be secured onto the valve cap by means of one or more set screws, and is held in position by means of the toilet water inlet pipe.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
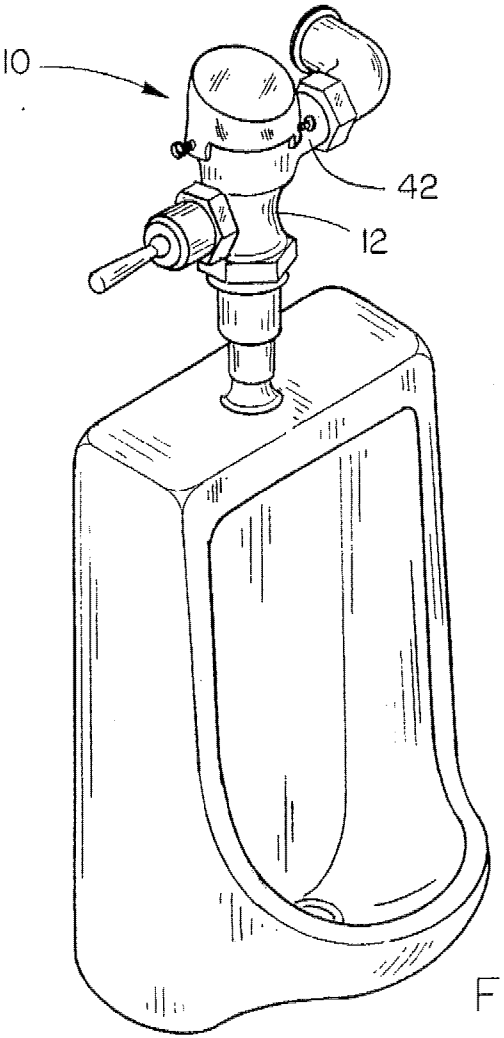
FIG. 1 is a perspective view of a first embodiment of the invention in place on a flush valve.

Referring now to the drawings, wherein like reference numerals designate identical or corresponding parts throughout the several views, FIG. 1 depicts the invention 10, positioned on a urinal flush valve 12. A first embodiment of the invention is shown in an exploded view in FIG. 2 and comprises a clear plastic valve cap cover 14, with an angled flat upper face 16, a substantially cylindrical sidewall 18, and three securement flanges 20, 22, 24. The upper face 16 is preferably angled toward the front of the device to provide for easier viewing of the advertising display 26 inserted thereunder. The advertising display 26, which is cut to conform with the circular upper face 16, may be held in place beneath the upper face 16 by means of a support plate 28, which rests on the flush valve wrench boss 30 of the flush valve cap 32 (FIG. 3 & 5).

Figure 2:
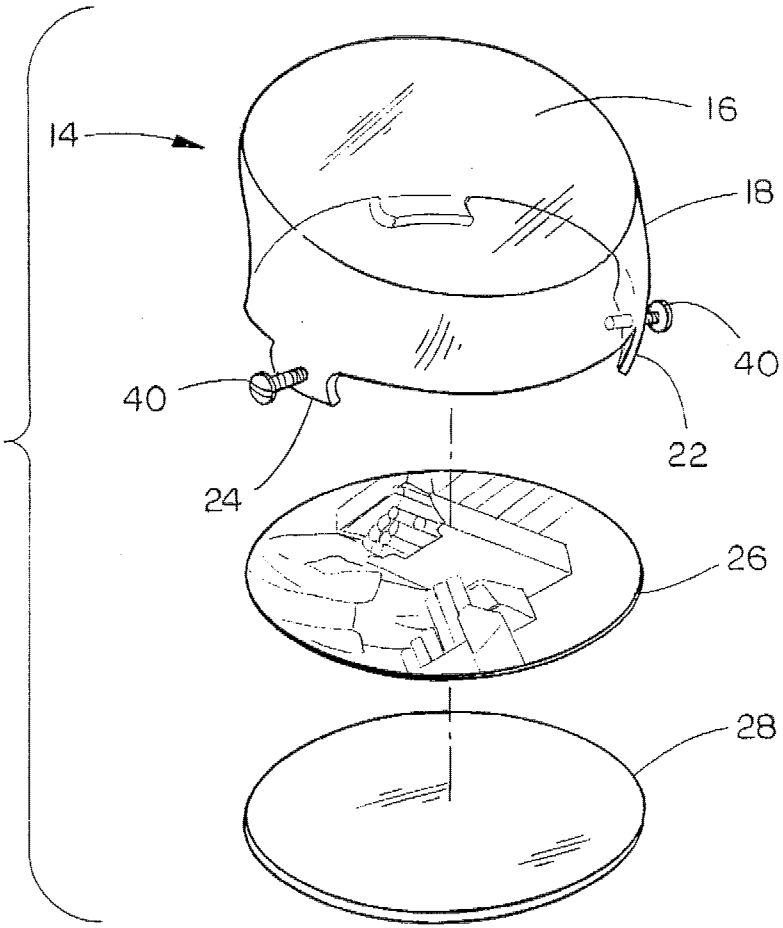
FIG. 2 is an exploded view of a first embodiment of the invention.
Figure 3:
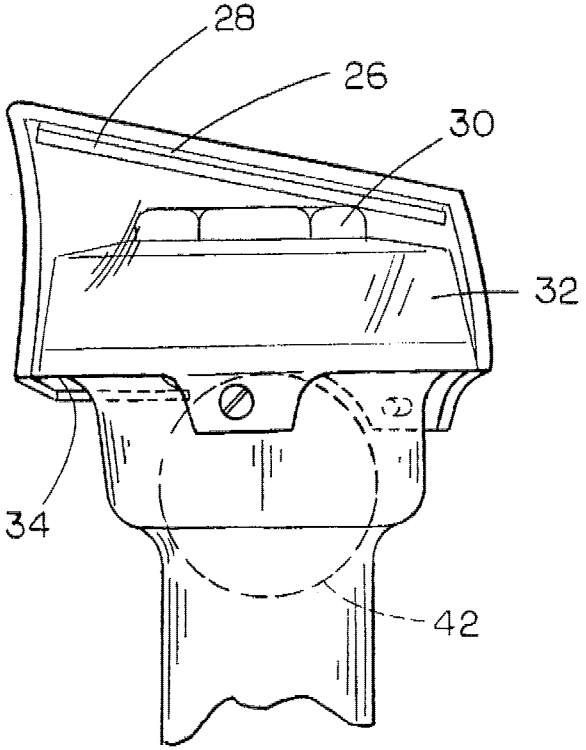
FIG. 3 is a side view, in partial section, of the first embodiment in place on a flush valve cap.

Referring now to FIGS. 2 and 3, the first embodiment utilizes three securement flanges 20, 22, 24 to hold the invention 10 in place on the flush valve cap 32. A first flange 20 is inwardly curved so as to fit beneath the lower circumferential edge 34 of the valve cap 32. The remaining flanges 22, 24 extend downwardly from the cylindrical sidewall 18 and are each fitted with a set screw 40 which, when threaded through its respective flange, will secure the invention 10 upon the valve cap 32. The three flanges 20, 22, 24 are preferably oriented as depicted in FIG. 2 with the curved flange 20 to the right rear of the device, a straight flange 22 to the right front of the device, and a straight flange 24 to the left of the device. Further the right-roar flange 20 and right-front flange 22 should be spaced so as to fit snugly adjacent the water inlet pipe 42 so as to prevent rotation of the device upon the valve cap 32.

Figure 5:
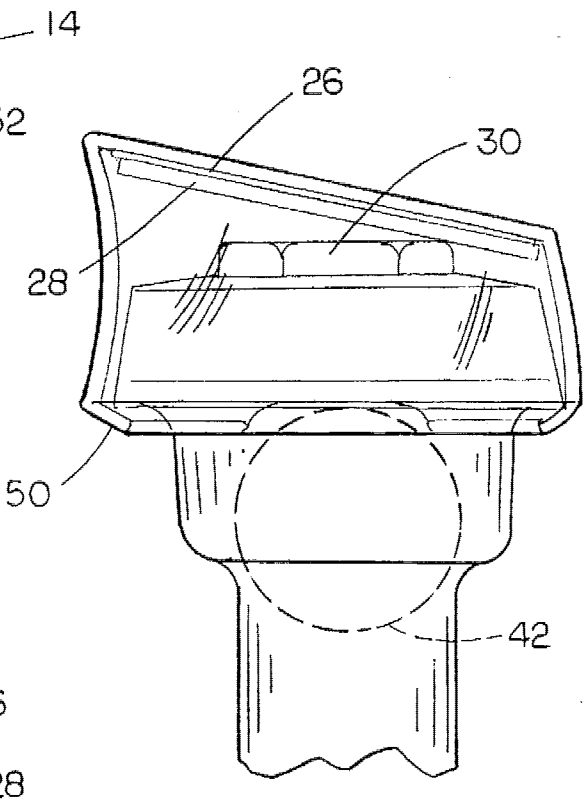
FIG. 5 is a side view, in partial section, of the second embodiment in place on a flush valve cap.
Figure 4:
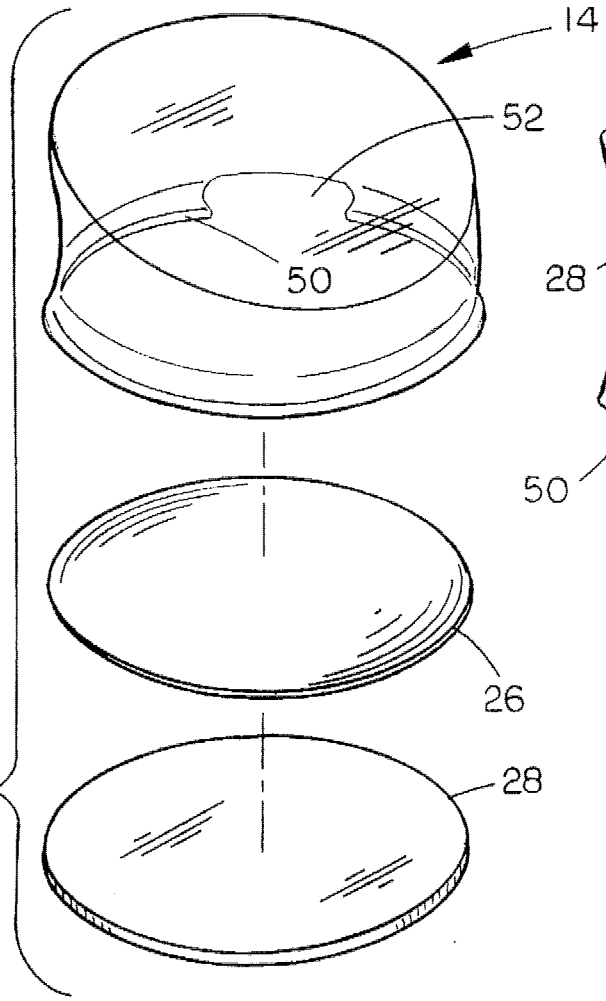
FIG. 4 is an exploded view of a second embodiment of the invention.

A second embodiment of the invention 10 is depicted in FIGS. 4 and 5, and utilizes a circumferential, generally uniform inwardly turned lip 50 around the lower edge of the sidewall 18 to secure the valve cap cover 14 in place. This embodiment will preferably have a cutout 52 on the right side of the lip 50 to fit over the water inlet pipe 42 so as to prevent rotation.

In addition, the flange 50 further defines an enlarged opening 54 in the bottom of the cap cover 14, wherein the opening 54 is dimensioned to engage the sloped sides 34 of the flush valve cap 32 and engage the underside 36 thereof in a snap-fit fashion.

Figure 7:
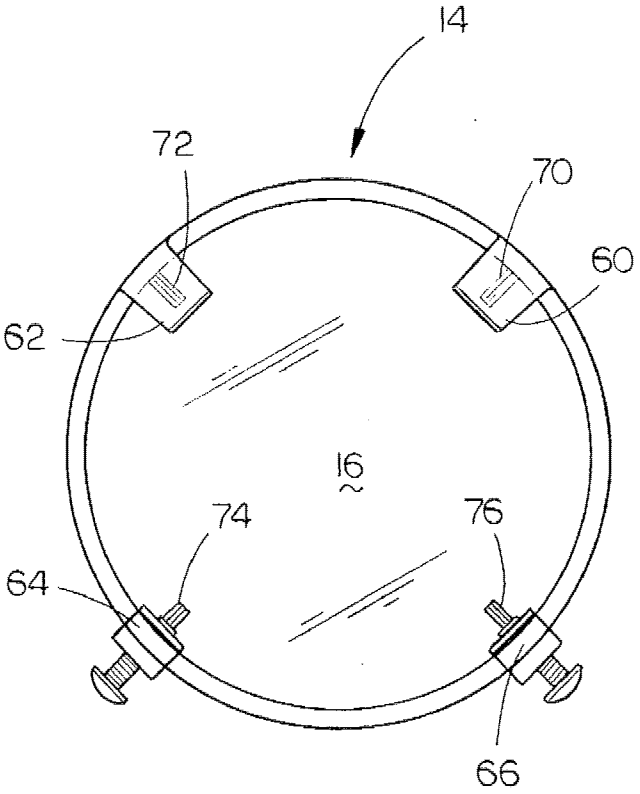
FIG. 7 is a bottom plan view of the third embodiment.
Figure 6:
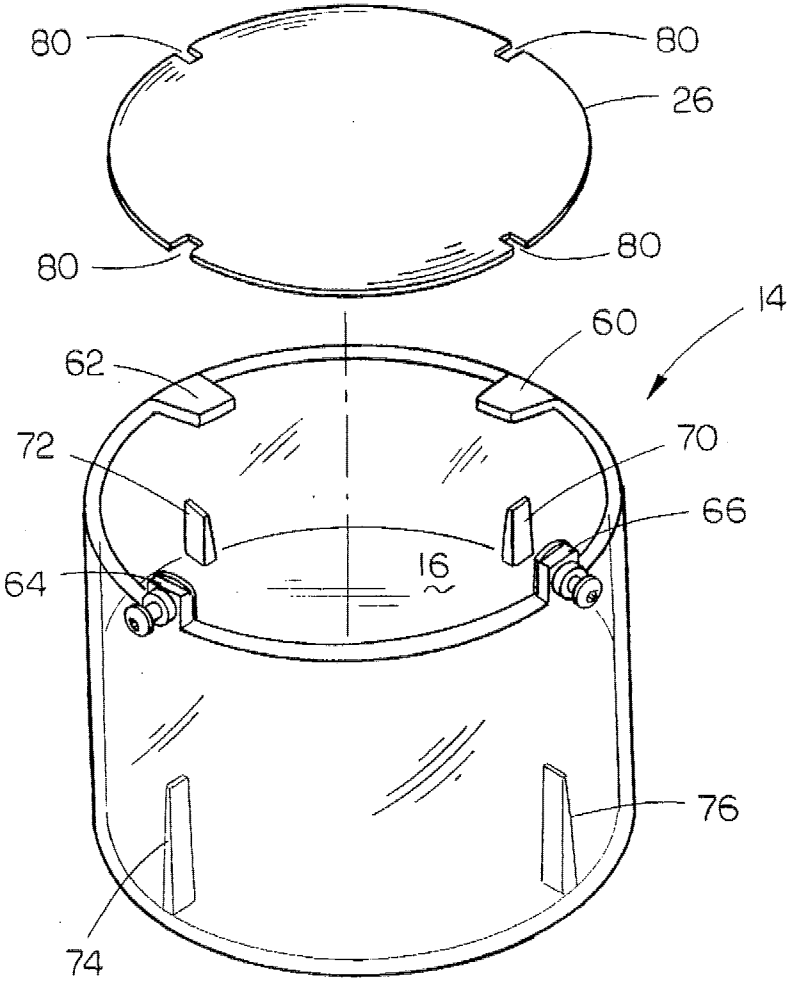
FIG. 6 is an exploded rear perspective view of a third embodiment of the invention.

Turning now to FIGS. 6 and 7, it can be seen that in the third and preferred embodiment of the invention, the cap cover 14 is provided with a pair of inwardly directed securement flanges 60, 62, a pair of downwardly directed securement flanges 64, 66, and a plurality of internal ribs 70, 72, 74, 76 whose purpose and function will be described presently.

As can best be seen by reference to FIG. 7, the inwardly directed securement flanges 60, 62 are radially disposed 90° apart around the lower periphery of the cap cover 14 and each inwardly disposed securement flange 60, 62 is diametrically opposed relative to one of the pair of downwardly directed securement flanges 64, 66.

Turning now to FIG. 7 it can be seen that the plurality of internal ribs 70, 72, 74, 76 are radially disposed 90° apart around the interior of the cap cover 14 and each of the ribs 70, 72, 74, 76 are also aligned with a selected one of the securement flanges 60, 62, 64, 66. In addition, one relatively short pair of internal ribs 70, 72 are aligned with the inwardly directed securement flanges 60, 62 and the other relatively long pair of internal ribs 74, 76 are aligned with the downwardly directed securement flanges 64, 66.

It should further be noted that all of the internal ribs extend downwardly from the angled flat upper face 16 of the cap cover 14 and terminate along the same horizontal plane within the interior of the cap cover 14.

Not only do the internal ribs 70, 72, 74, 76 provide structural rigidity to the cap cover 14, but the bottom of the ribs 70, 72, 74, 76 provide bearing surfaces that rest on the top of the flush valve cap 32. In addition, the sides of the ribs 70, 72, 74, 76 serve as guides to register a suitably notched advertising display 26 in the proper orientation relative to the angled face 16 of the cap cover 14, such that the advertising display 26 will not only be properly aligned relative to the cap cover 14, but will also be prevented from rotating relative thereto.

It should further be noted that under certain circumstances, the notches 80 in the advertising display 26 can obviate the need for the support plate 28, such as when the advertising display 26 has a sufficient thickness that the frictional engagement of the notches 80 with the sides of the ribs 70, 72, 74, 76 is more than adequate for the purpose of maintaining the advertising display in place.

While the invention has been described with a certain degree of particularity, it is manifest that many changes may be made in the details of construction and the arrangement of the components without departing from the spirit and scope of the disclosure. It is therefore to be understood that the invention is not limited to the embodiments set forth herein for purposes of exemplification, but is to be limited only by the scope of the appended claims, including the full range of equivalency to which each element thereof is entitled.

What is claimed is:

1. An advertisement display device for placement upon a flush valve cap having a wrench boss protruding from a substantially horizontal upper surface and a substantially cylindrical body having a lower circumferential edge, comprising:

(a) a plastic flush valve cap cover having a generally flat upper face and a substantially cylindrical sidewall having a lower edge;

(b) a plurality of flanges extending from said lower edge of said cylindrical sidewall wherein said plurality of flanges includes a pair of downwardly directed securement flanges and a pair of inwardly directed securement flanges;

(c) a pair of set screws operatively associated with said pair of downwardly directed securement flanges; and (d) a plurality of ribs arranged around an interior of said flush valve cover.

2. The advertisement display device as recited in claim 1 wherein said plurality of ribs are aligned with said plurality of flanges.

3. The advertisement display device as recited in claim 2 wherein said plurality of ribs comprise a pair of relatively long ribs aligned with said pair of downwardly directed securement flanges and a pair of relatively short ribs that are aligned with said pair of inwardly directed securement flanges.

4. The advertisement display device as recited in claim 3 wherein said plurality of ribs terminate along the same general horizontal plane within said interior of the flush valve cover.

5. The advertisement display device as recited in claim 1 and further including an advertising display provided with a plurality of notches which are dimensioned to frictionally engage said plurality of ribs.

* * * * *